US009076393B2

(12) United States Patent
Kim et al.

(10) Patent No.: US 9,076,393 B2
(45) Date of Patent: Jul. 7, 2015

(54) TIMING CONTROLLER AND LIQUID CRYSTAL DISPLAY DEVICE COMPRISING THE SAME

(71) Applicant: LG Display Co., Ltd., Seoul (KR)

(72) Inventors: JongWoo Kim, Paju-si (KR); SunWoo Park, Gwacheon-si (KR)

(73) Assignee: LG Display Co., Ltd., Seoul (KR)

( * ) Notice: Subject to any disclaimer, the term of this patent is extended or adjusted under 35 U.S.C. 154(b) by 238 days.

(21) Appl. No.: 13/728,322

(22) Filed: Dec. 27, 2012

(65) Prior Publication Data

US 2013/0215090 A1 Aug. 22, 2013

(30) Foreign Application Priority Data

Feb. 20, 2012 (KR) ..... 10-2012-0017132

(51) Int. Cl.
*G09G 3/36* (2006.01)

(52) U.S. Cl.
CPC ..... *G09G 3/36* (2013.01); *G09G 3/3648* (2013.01); *G09G 2300/0426* (2013.01); *G09G 2310/08* (2013.01)

(58) Field of Classification Search
None
See application file for complete search history.

(56) References Cited

U.S. PATENT DOCUMENTS

| | | | | |
|---|---|---|---|---|
| 2004/0070589 | A1 * | 4/2004 | Morita et al. | 345/690 |
| 2004/0263448 | A1 * | 12/2004 | Baek et al. | 345/87 |
| 2005/0041006 | A1 * | 2/2005 | Lee et al. | 345/99 |
| 2007/0126686 | A1 | 6/2007 | Chang et al. | |
| 2008/0136809 | A1 | 6/2008 | Lee et al. | |
| 2009/0201272 | A1 | 8/2009 | Ahn et al. | |
| 2009/0213056 | A1 * | 8/2009 | Nam et al. | 345/90 |
| 2009/0231323 | A1 * | 9/2009 | Kang et al. | 345/213 |
| 2010/0091591 | A1 | 4/2010 | Byun | |
| 2010/0321353 | A1 * | 12/2010 | Bae et al. | 345/205 |
| 2011/0115724 | A1 * | 5/2011 | Jeon et al. | 345/173 |
| 2012/0044126 | A1 * | 2/2012 | Shin | 345/1.3 |
| 2012/0146980 | A1 * | 6/2012 | Lee et al. | 345/211 |
| 2013/0050172 | A1 | 2/2013 | Li et al. | |

* cited by examiner

*Primary Examiner* — Srilakshmi K Kumar
*Assistant Examiner* — Deeprose Subedi
(74) *Attorney, Agent, or Firm* — Fenwick & West LLP

(57) ABSTRACT

Disclosed are a timing controller and an LCD device including the same. The timing controller sequentially drives a plurality of sub-pixels, which are arranged in parallel on the same horizontal line, during a plurality of horizontal period. The timing controller includes a timing signal generation unit generating a first data enable signal on the basis of an active period of a data enable input signal supplied from the reception unit, generating a second data enable signal on the basis of an abnormal period generated during the active period, and generating a data enable output signal on the basis of the first and second data enable signals, and a data processing unit selecting display data corresponding to sequential driving of the horizontal periods among from the temporarily stored data according to the data enable output signal, and outputting the selected display data.

21 Claims, 6 Drawing Sheets

TIMING CONTROLLER AND LIQUID CRYSTAL DISPLAY DEVICE COMPRISING THE SAME

CROSS-REFERENCE TO RELATED APPLICATIONS

This application claims the benefit of Korean Patent Application No. 10-2012-0017132 filed on Feb. 20, 2012, which is hereby incorporated by reference as if fully set forth herein.

BACKGROUND

1. Field of the Invention

The present invention relates to a liquid crystal display (LCD) device, and more particularly, to a timing controller and an LCD device including the same, which can prevent an image-quality defect due to an abnormal data enable input signal caused by noise such as static electricity.

2. Discussion of the Related Art

Recently, flat panel display devices that can decrease a weight and a volume corresponding to the limitations of cathode ray tubes (CRTs) are being developed. Liquid crystal display (LCD) devices, plasma display panels (PDPs), field emission display (FED) devices, and light emitting display devices are actively being researched as flat type display devices. However, among such flat panel display devices, LCD devices are easily manufactured, have good drivability of drivers, realize a high-quality image, and thus are attracting much attention.

LCD devices control a light transmittance of a liquid crystal layer with an electric field that is applied to the liquid crystal layer in response to a video signal, thereby displaying an image. The LCD devices have a small size, a thin thickness, and low power consumption, and thus are being applied to televisions, portable computers such as notebook computers, monitors, office automation equipment, audio/video equipment, etc.

LCD devices include a gate driver integrated circuit (IC) for driving a plurality of gate lines and a data driver IC for driving a plurality of data lines. As the LCD devices enlarge in size and become higher in resolution, the number of driver ICs increases. However, since the data driver IC is far more expensive than the gate driver IC, various schemes are recently proposed for decreasing the number of data driver ICs.

As technology for decreasing the number of data driver ICs, LCD devices such as Korean Patent Publication No. 10-2010-0060377 (hereinafter referred to as a patent document) have been known.

The patent document increases the number of existing gate lines by two times but decreases half of the existing data lines, and thus decreases the number of existing data driver ICs by half. Accordingly, the patent document discloses a double rate driving (DRD) type LCD device that realizes resolution equal to the existing resolution.

The DRD type LCD device drives n (where n is a natural number equal to or more than two) number of liquid crystal cells, disposed on one horizontal line, with two gate lines and n/2 number of data lines. In the DRD type LCD device, a timing controller malfunctions due to noise such as static electricity to output various control signals at a timing different from that of a normal state, causing an image-quality defect such as an abnormal screen having a flashing state due to data mixing.

The timing controller generates a data enable signal corresponding to the DRD type on the basis of a data enable input signal inputted from an external system. Also, the timing controller maps input data inputted from the external system to be in correspondence with the DRD type, writes the mapped data in an internal line memory according to the data enable input signal, and reads one horizontal data mapped into the line memory to supply the one horizontal data to the data driver IC according to the data enable signal. Furthermore, the timing controller generates and outputs various control signals for driving the data driver IC and the gate driver IC in the DRD type on the basis of the data enable signal.

However, when static electricity is mixed into the data enable input signal inputted from the external system to the timing controller, the timing controller generates the data enable signal according to the data enable input signal with the static electricity mixed there into. For this reason, the data enable signal has abnormal timing, and thus, a timing that reads and writes the line memory deviates from a normal timing, whereby the timing controller cannot write desired data in the line memory or read desired data from the line memory.

Moreover, since the timing controller generates and outputs various control signals for driving the data driver IC and the gate driver IC in the DRD type on the basis of the abnormal data enable signal, an image-quality defect such as an abnormal screen having a flashing state is caused by omission of a display line or data mixing.

SUMMARY

Accordingly, the present invention is directed to a timing controller and a LCD device including the same that substantially obviate one or more problems due to limitations and disadvantages of the related art.

An aspect of the present invention is directed to a timing controller and an LCD device including the same, which can prevent an image-quality defect due to an abnormal data enable input signal caused by noise such as static electricity.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided a timing controller for sequentially driving a plurality of sub-pixels, which are arranged in parallel on the same horizontal line, during a plurality of horizontal period, including: a reception unit receiving input data and a data enable input signal; a timing signal generation unit generating a first data enable signal on the basis of an active period of the data enable input signal supplied from the reception unit, generating a second data enable signal on the basis of an abnormal period generated during the active period, and generating a data enable output signal on the basis of the first and second data enable signals; and a data processing unit temporarily storing the input data according to the data enable input signal, selecting display data corresponding to sequential driving of the horizontal periods among from the temporarily stored data according to the data enable output signal, and outputting the selected display data.

When the first and second data enable signals overlap partially, the timing signal generation unit may mask the first data enable signal overlapping the second data enable signal to generate the data enable output signal.

The timing signal generation unit may perform a logical operation on the first and second data enable signals to generate a third data enable signal, generate a masking signal according to whether the first and second data enable signals overlap, and perform a logical operation on the third data enable signal and the masking signal to generate the data enable output signal.

The first data enable signal may include: a first enable period corresponding to an odd horizontal period among the plurality of horizontal periods; and a second enable period corresponding to an even horizontal period among the plurality of horizontal periods, the first and second enable periods being alternately generated during the active period of the data enable input signal, and the second data enable signal may include: a third enable period that is generated in synchronization with the abnormal period; or third and fourth enable periods that are successively generated in synchronization with the abnormal period to have the same form as the first and second enable periods.

The timing signal generation unit may include: a first data enable signal generation unit generating the first data enable signal in which a first enable period corresponding to an odd horizontal period among the plurality of horizontal periods and a second enable period corresponding to an even horizontal period among the plurality of horizontal periods are alternately repeated during the active period of the data enable input signal; a second data enable signal generation unit generating the second data enable signal that has third and fourth enable periods that are alternately repeated to have the same form as the first and second enable periods during a vertical blank period of the data enable input signal, and has the third enable period or the third and fourth enable periods during the abnormal period; a masking signal generation unit generating a masking signal according to whether the first and second data enable signals overlap; and a data enable output signal generation unit performing a logical operation on the first and second data enable signals to generate a third data enable signal, and performing a logical operation on the third data enable signal and the masking signal to generate the data enable output signal.

In another aspect of the present invention, there is provided an LCD device including: a liquid crystal display panel including a plurality of sub-pixels that are respectively formed in a plurality of areas prepared by intersections between a plurality of gate lines and a plurality of data lines; the timing controller; a gate driver sequentially driving the m gate lines to sequentially connect a plurality of sub-pixels, which are arranged in parallel on the same horizontal line, to a plurality of gate lines according to a gate control signal supplied from the timing controller; and a data driver receiving display data and a data control signal from the timing controller, and converting the display data into data voltages to supply the data voltages to the respective data lines to be synchronized with the driving of the gate lines according to the data control signal.

Two adjacent sub-pixels that are arranged in parallel on the same horizontal line may be in common connected to one data line, and sequentially driven according to sequential driving of two gate lines.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

Figure 1:
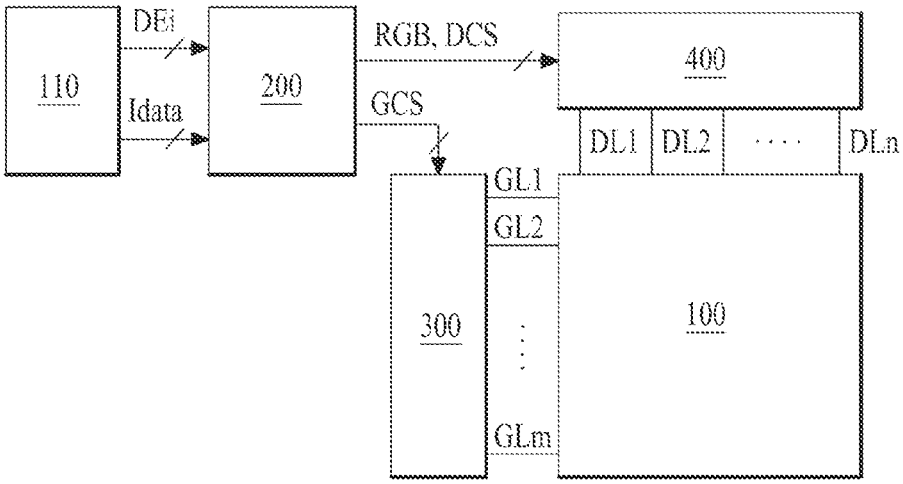
FIG. 1 is a diagram schematically illustrating an LCD device according to an embodiment of the present invention.
Figure 2:
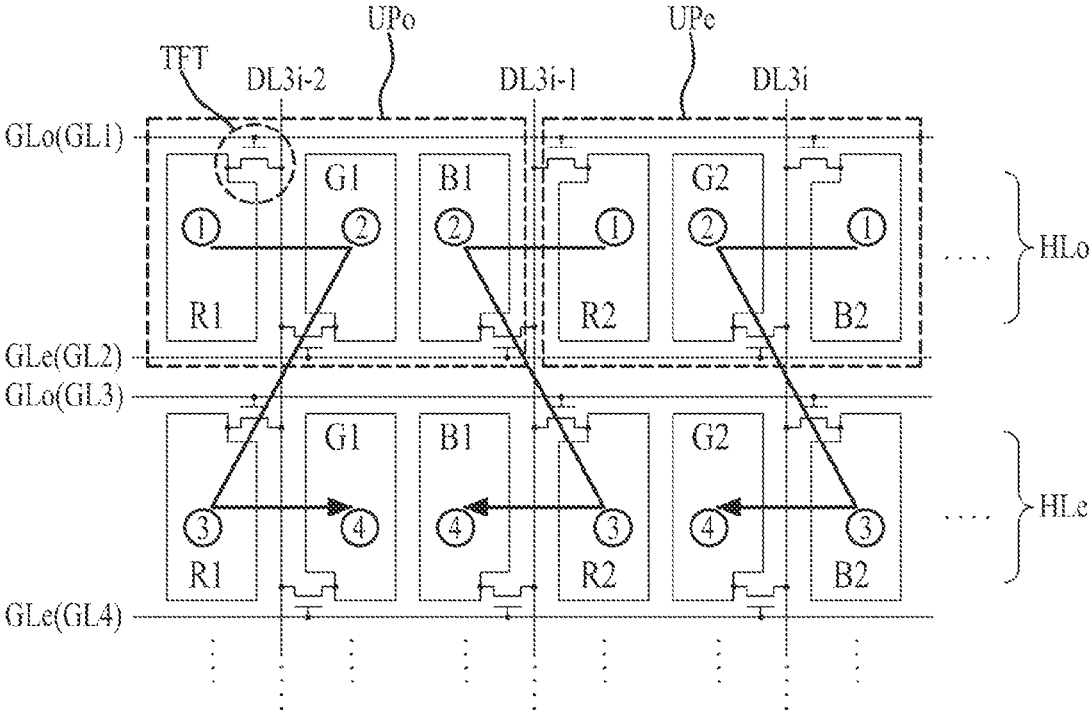
FIG. 2 is a diagram schematically illustrating a pixel arrangement structure of a liquid crystal display panel of FIG. 1 according to one embodiment.

FIG. 1 is a diagram schematically illustrating an LCD device according to an embodiment of the present invention. FIG. 2 is a diagram schematically illustrating a pixel arrangement structure of a liquid crystal display panel of FIG. 1 according to one embodiment.

Referring to FIGS. 1 and 2, the LCD device according to an embodiment of the present invention includes a liquid crystal display panel 100, a timing controller 200, a gate driver 300, and a data driver 400.

The liquid crystal display panel 100 includes a liquid crystal layer (not shown) formed between a lower substrate (not shown) and an upper substrate (not shown) that are facing-coupled. The liquid crystal display panel 100 includes a plurality of liquid crystal cells that are respectively prepared in a plurality of pixel areas prepared by intersections between a plurality of gate lines GL1 to GLm and a plurality of data lines DL1 to DLn.

The lower substrate includes n number of data lines DL1 to DLn that are vertically formed at certain intervals, m number of gate lines GL1 to GLm that are horizontally formed at certain intervals and intersect the data lines DL1 to DLn, a plurality of thin film transistors TFT that are connected to a corresponding gate line GL and a corresponding data line DL, a plurality of pixel electrodes of the respective liquid crystal cells which are connected to a corresponding thin film transistor TFT, and a plurality of storage capacitors (not shown) that are connected to a corresponding thin film transistor TFT.

The upper substrate includes: a black matrix that defines a pixel area for each of the liquid crystal cells; red, green, and blue color filters that are formed in the respective pixel areas; and a common electrode. In this case, when a driving mode of the liquid crystal cell is a vertical electric field driving mode such as a twisted nematic (TN) mode or a vertical alignment (VA) mode, the common electrode is formed in the upper substrate, and, when the driving mode of the liquid crystal cell is a lateral electric field driving mode such as an in-plane switching (IPS) mode or a fringe field switching (FFS) mode, both the common electrode and the pixel electrode are formed in the lower substrate.

An upper polarizer and a lower polarizer are respectively attached to the upper substrate and the lower substrate, and the polarizing axis of the lower polarizer is vertical to that of the upper polarizer. Also, an alignment layer for setting the pre-tilt angles of liquid crystal molecules configuring the liquid crystal layer is formed at an inner surface (contacting the liquid crystal layer) of each of the upper substrate and lower substrate.

The liquid crystal display panel 100 displays a certain color image by combination of red light, green light, and blue light that are emitted from the backlight unit and pass through the liquid crystal layer and the color filters according to the driving of the liquid crystal cells. Therefore, the liquid crystal display panel 100 includes n m number of unit pixels, each of which includes a red sub-pixel for displaying a red image, a green sub-pixel for displaying a green image, and a blue sub-pixel for displaying a blue image. In this case, a plurality of sub-pixels disposed on a horizontal line corresponding to a length direction of each gate line are arranged in the order of red, green, and blue.

Moreover, each of sub-pixels arranged on each horizontal line is driven by the driving of one corresponding data line and the driving of two corresponding gate lines according to the DRD type.

A connection structure of each sub-pixel according to the DRD type will be described in detail with reference to FIG. 2.

A red sub-pixel "R1, . . . " of an odd-numbered unit pixel UPo is connected to an odd-numbered gate line GLo and a 3i-2nd (where i is a natural number) data line DL3*i*-2 through a corresponding TFT. A green sub-pixel "G1, . . . " of the odd-numbered unit pixel UPo is connected to an even-numbered gate line GLe and the 3i-2nd data line DL3*i*-2 through a corresponding TFT. That is, the red sub-pixel "R1, . . . " and green sub-pixel "G1, . . . " of the odd-numbered unit pixel UPo share the 3i-2nd data line DL3*i*-2.

A blue sub-pixel "B1, . . . " of the odd-numbered unit pixel UPo is connected to the even-numbered gate line GLe and a 3i-1st data line DL3*i*-1 through a corresponding TFT. A red sub-pixel "R2, . . . " of the even-numbered unit pixel UPe is connected to the odd-numbered gate line GLo and the 3i-1st data line DL3*i*-1 through a corresponding TFT. That is, the blue sub-pixel "B1, . . . " of the odd-numbered unit pixel UPo and the red sub-pixel "R2, . . . " of the even-numbered unit pixel UPe share the 3i-1st data line DL3*i*-1.

A green sub-pixel "G2, . . . " of the even-numbered unit pixel UPe is connected to the even-numbered gate line GLe and a 3ith data line DL3*i* through a corresponding TFT. A blue sub-pixel "B2, . . . " of the even-numbered unit pixel UPe is connected to the odd-numbered gate line GLo and the 3ith data line DL3*i* through a corresponding TFT. That is, the green sub-pixel "G2, . . . " and blue sub-pixel "B2, . . . " of the even-numbered unit pixel UPe share the 3ith data line DL3*i*.

In the connection structure of each sub-pixel, a gate signal supplied to the odd-numbered gate line GLo allows data to be charged into the red sub-pixel "R1, . . . " of the odd-numbered unit pixel UPo and the red sub-pixel "R2, . . . " and blue sub-pixel "B2, . . . " of the even-numbered unit pixel UPe. Also, a gate signal supplied to the even-numbered gate line GLe allows data to be charged into the green sub-pixel "G1, . . . " and blue sub-pixel "B1, . . . " of the odd-numbered unit pixel UPo and the green sub-pixel "G2, . . . " and of the even-numbered unit pixel UPe.

A DRD method based on the connection structure of each sub-pixel will now be described.

First, the gate signal is sequentially supplied to odd-number and even-numbered gate lines GLo and GLe for driving respective corresponding sub-pixels of an odd-numbered horizontal line HLo. Therefore, data are respectively charged into the red sub-pixel "R1, . . . " of the odd-numbered unit pixel UPo and the red sub-pixel "R2, . . . " and blue sub-pixel "B2, . . . " of the even-numbered unit pixel UPe according to the gate signal of the odd-numbered gate line GLo (see (1) in FIG. 2), and data are respectively charged into the green sub-pixel "G1, . . . " and blue sub-pixel "B1, . . . " of the odd-numbered unit pixel UPo and the green sub-pixel "G2, . . . " of the even-numbered unit pixel UPe according to the gate signal of the even-numbered gate line GLe (see (2) in FIG. 2).

Subsequently, the gate signal is sequentially supplied to odd-number and even-numbered gate lines GLo and GLe for driving respective corresponding sub-pixels of an even-numbered horizontal line HLe. Therefore, data are respectively charged into the red sub-pixel "R1, . . . " of the odd-numbered unit pixel UPo and the red sub-pixel "R2, . . . " and blue sub-pixel "B2, . . . " of the even-numbered unit pixel UPe according to the gate signal of the odd-numbered gate line GLo (see (3) in FIG. 2), and data are respectively charged into the green sub-pixel "G1, . . . " and blue sub-pixel "B1, . . . " of the odd-numbered unit pixel UPo and the green sub-pixel "G2, . . . " and of the even-numbered unit pixel UPe according to the gate signal of the even-numbered gate line GLe (see (4) in FIG. 2).

The timing controller 200 receives and processes video data Idata inputted from a driving system 110 to generate DRD-type red, green, and blue data RGB to be displayed on the liquid crystal display panel 100, and supplies the data RGB to the data driver 400. The timing controller 200 controls the driving timing of each of the gate driver 300 and data driver 400 on the basis of a data enable input signal Dei inputted from the driving system 110.

Specifically, the timing controller 200 generates first and second data enable signals on the basis of the data enable input signal DEi inputted from the driving system 110, and removes a noise signal (or abnormal period) mixed into the data enable input signal DEi to generate a data enable output signal on the basis of the first and second data enable signals. The timing controller 200 receives the input data Idata inputted from the driving system 110 to restore the input data Idata to restoration data Rdata, temporarily stores the restoration data Rdata according to the data enable input signal DEi, and reads one horizontal-line red, green, and blue data RGB (corresponding to a DRD-type pixel arrangement structure) from the temporarily stored data to supply the read data RGB to the data driver 400 according to the data enable output signal.

Furthermore, the timing controller 200 generates a data control signal DCS for controlling the driving timing of the data driver 400 and a gate control signal GCS for controlling the driving timing of the gate driver 300 on the basis of the data enable output signal. Here, the data control signal DCS may include a source start signal, a source shift clock, a source enable signal, and a polarity control signal. The gate control signal GCS may include a gate start signal, a plurality of gate shift clocks, and a gate output enable signal.

The driving system 110 converts video data corresponding to a certain image into data based on a low voltage differential signal (LVDS) interface type to transfer the converted data to the timing controller 200, and transfers the video data and the data enable input signal DEi to the timing controller 200. In this case, the LVDS interface is a high-speed digital interface. The LVDS interface generates two differential signals having opposite polarities, and transfers the data with reference to the two differential signals, in which case the LVDS interface may transfer the data at a low voltage, low consumption power, and a high speed.

The gate driver 300 generates the gate signal and sequentially supplies the gate signal to the m gate lines GL1 to GLm, according to the gate control signal supplied from the timing controller 200. In this case, a plurality of the gate signals respectively supplied to the m gate lines GL1 to GLm may be shifted in units of one horizontal period, or may overlap in units of half a horizontal period. The gate driver 300 may be formed on the lower substrate of the liquid crystal display panel 100, in which case the gate driver 300 is formed simultaneously with a process of forming the thin film transistors. The gate driver 300 includes a plurality of gate driver ICs, each of which may be directly connected to a gate pad part prepared in the lower substrate of the liquid crystal display panel 100 or may be mounted on a gate circuit film and connected to the gate pad part prepared in the lower substrate of the liquid crystal display panel 100.

The data driver 400 converts one horizontal-line red, green, and blue data RGB, inputted from the timing controller 200, into data voltages corresponding to a specific inversion type, and supplies the data voltages to the data lines DL1 to DLn. That is, the data driver 400 receives the one horizontal-line red, green, and blue data RGB inputted from the timing controller 200, latches the one horizontal-line red, green, and blue data RGB according to the data control signal supplied from the timing controller 200, converts the latched red, green, and blue data RGB into positive and negative data voltages with positive and negative gamma voltages, and selects the positive and negative data voltages according to the polarity control signal to respectively supply the selected positive and negative data voltages to the data lines DL1 to DLn. Therefore, data voltages based on the DRD type are supplied to the data lines DL1 to DLn.

The data driver 400 includes a plurality of data driver ICs, each of which may be directly connected to a data pad part prepared in the lower substrate of the liquid crystal display panel 100 or may be mounted on a data circuit film and connected to the data pad part prepared in the lower substrate of the liquid crystal display panel 100.

Figure 3:
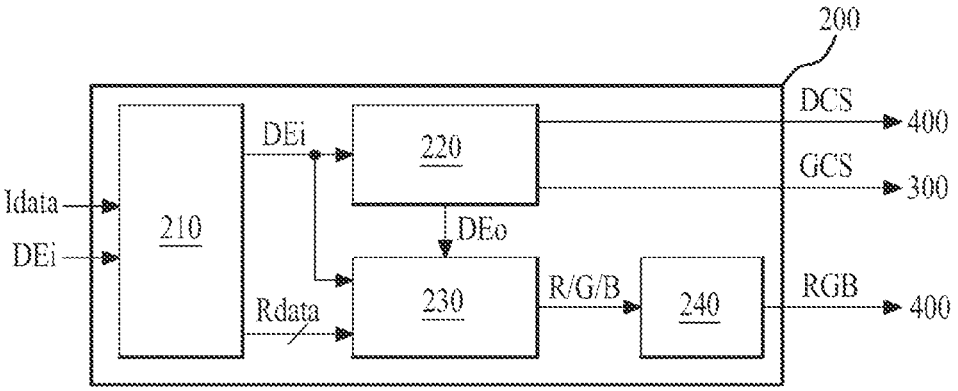
FIG. 3 is a block diagram schematically illustrating a timing controller according to an embodiment of the present invention.
Figure 4:
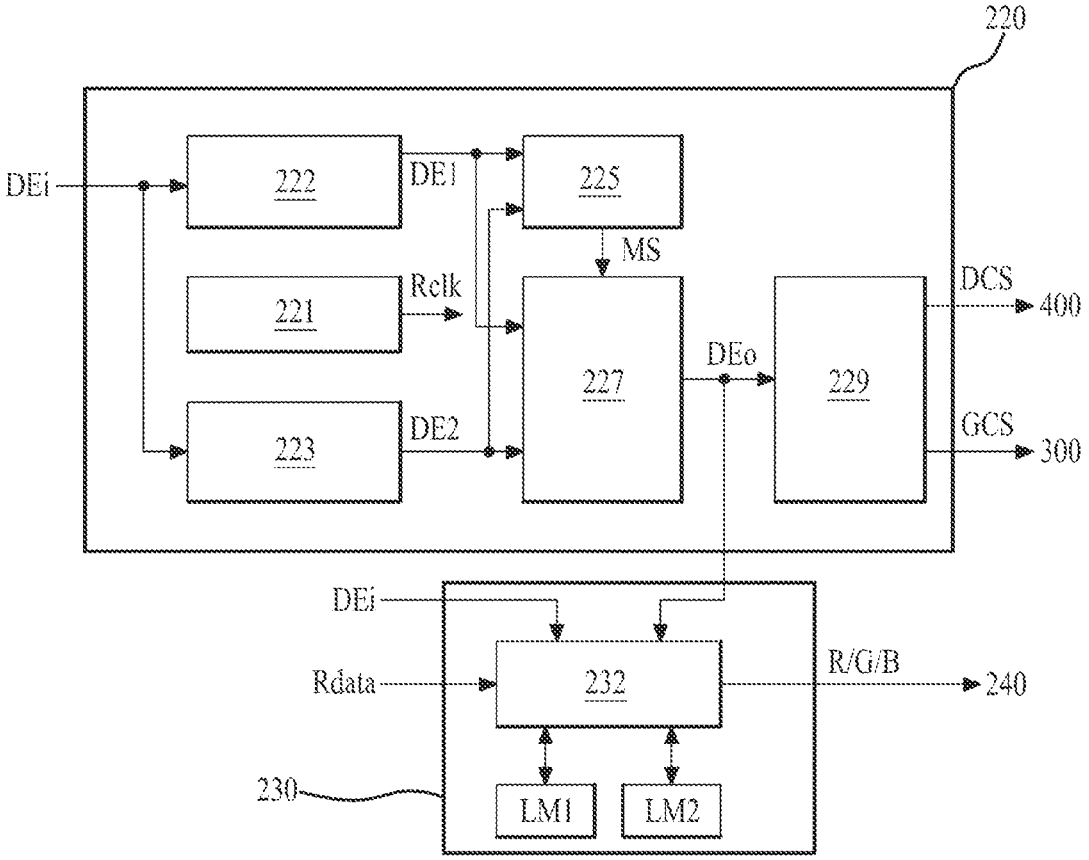
FIG. 4 is a block diagram schematically illustrating a timing signal generation unit of FIG. 3 according to one embodiment.
Figure 5:
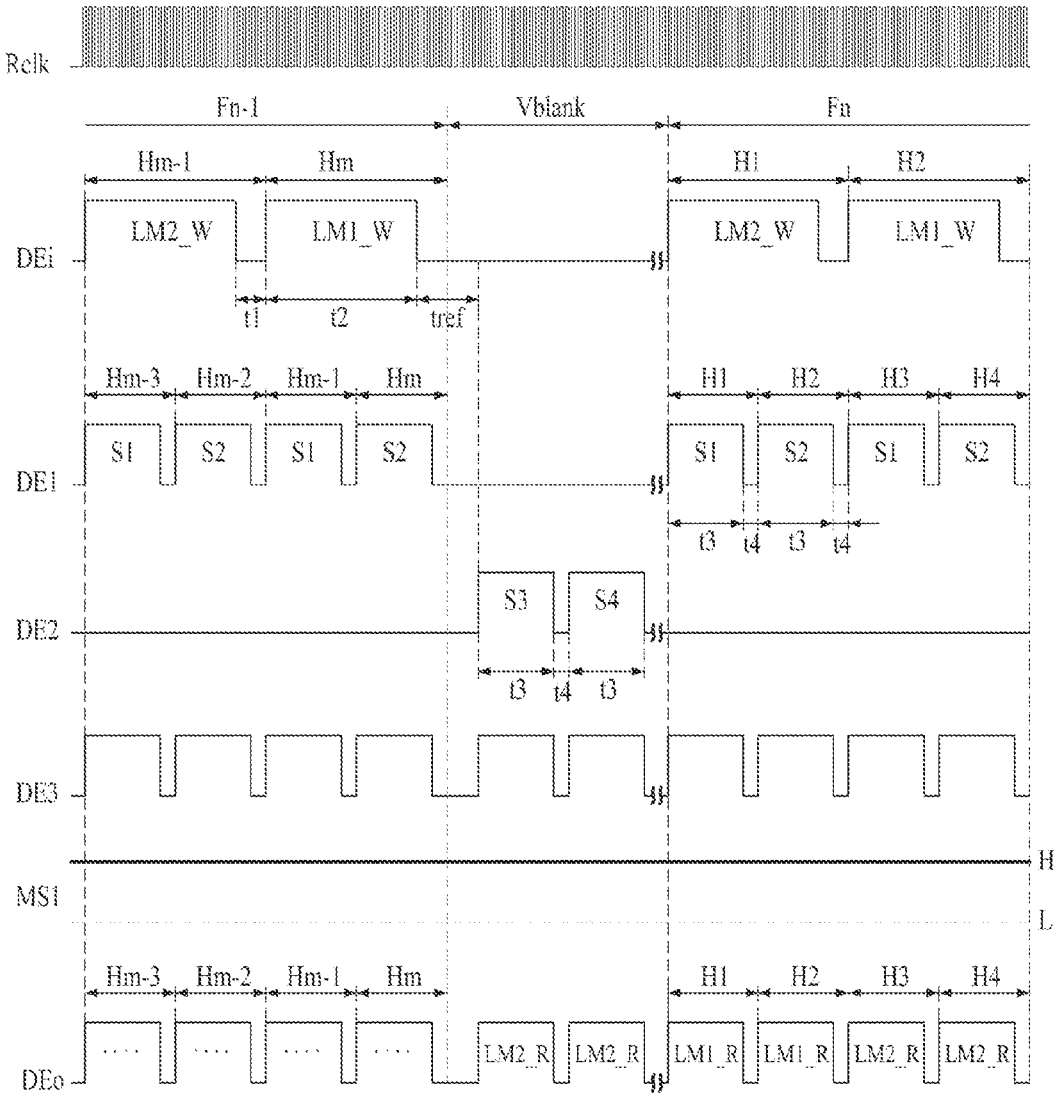
FIG. 5 is a waveform diagram showing waveforms of signals generated by the timing signal generation unit of FIG. 4.

FIG. 3 is a block diagram schematically illustrating a timing controller according to an embodiment of the present invention. FIG. 4 is a block diagram schematically illustrating a timing signal generation unit of FIG. 3 according to one embodiment. FIG. 5 is a waveform diagram showing waveforms of signals generated by the timing signal generation unit of FIG. 4.

Referring to FIGS. 3 to 5, the timing controller 200 according to an embodiment of the present invention includes a data reception unit 210, a timing signal generation unit 220, a data processing unit 230, and a data transfer unit 240.

The data reception unit 210 receives the video data Idata inputted from the driving system 110 in a specific interface type to restore the video data Idata to restoration data Rdata, and supplies the restoration data Rdata to the data processing unit 230. Also, the data reception unit 210 receives the data enable input signal DEi inputted from the driving system 110 and supplies the data enable input signal DEi to the timing signal generation unit 220.

The timing signal generation unit 220 generates a data enable output signal DEo on the basis of the data enable input signal DEi inputted from the data reception unit 210, in which case the timing signal generation unit 220 removes a noise signal mixed into the data enable input signal DEi to generate data enable output signal DEo. That is, the timing signal generation unit 220 generates a first data enable signal DE1 on the basis of an active period of the data enable input signal DEi and generates a second data enable signal DE2 on the basis of a vertical blank period Vblank of the data enable input signal DEi and/or an abnormal period in which the noise signal is mixed into the data enable input signal DEi. Furthermore, the timing signal generation unit 220 generates a masking signal according to whether the first and second data enable signals DE1 and DE2 overlap, and generates the data enable output signal DEo with the masking signal and the first and second data enable signals DE1 and DE2. Also, the timing signal generation unit 220 generates the data control signal DCS for controlling the driving timing of the data driver 400 and the gate control signal GCS for controlling the driving timing of the gate driver 300 on the basis of the data enable output signal DEo.

The timing signal generation unit 220 shown in FIG. 4 includes a clock generation unit 221, a first DE generation unit 222, a second DE generation unit 223, a masking signal generation unit 225, a data enable output signal generation unit 227, and a control signal generation unit 229.

The clock generation unit 221 generates a reference clock Rclk (having a certain period) to be internally used by the timing signal generation unit 220.

The first DE generation unit 222 generates the first data enable signal DE1 whose first and second enable periods S1 and S2 are alternately repeated during the active period of the data enable input signal DEi, on the basis of the active period of the data enable input signal DEi supplied from the data reception unit 210. That is, the first DE generation unit 222 generates the first data enable signal DE1 having first to mth horizontal periods H1 to Hm for sequentially driving a plurality of gate lines that have increased by two times according to the DRD type, during the active period of the data enable input signal DEi.

The first DE generation unit 222 according to an embodiment multiplies the active period of the data enable input signal DEi by two times, and generates the first data enable signal DE1 whose the first and second enable periods S1 and S2 are alternately repeated during the active period of the data enable input signal DEi. In this case, the first data enable signal DE1 maintains a low level during the vertical blank period Vblank of the data enable input signal DEi.

The first DE generation unit 222 according to another embodiment, as shown in FIG. 5, detects a time of each of one horizontal blank period t1 and one horizontal active period t2 of the last horizontal-period data enable input signal DEi of a previous frame Fn-1, and temporarily stored the detected times. Subsequently, the first DE generation unit 222 alternately generates the first and second enable periods S1 and S2 that have a high level during a time t3 (t3=t2/2) corresponding to half (t2/2) of the one horizontal active period t2 and have a low level during a time t4 (t4=t1/2) corresponding to half (t1/2) of the one horizontal blank period t2, during the active period of the data enable input signal DEi. Therefore, the first data enable signal DE1 has m number of horizontal periods H1 to Hm for sequentially driving the first to mth gate lines by the first and second enable periods S1 and S2 that are alternately generated during the active period of the data enable input signal DEi. The first DE generation unit 222 according to another embodiment may set a rising time and falling time of each of the first and second enable periods S1 and S2 of the first data enable signal DE1 by using a counter (not shown) for counting the reference clock Rclk.

The first enable period S1 of the first data enable signal DE1 is generated during a fore part among a fore part and latter part of each horizontal period H of the data enable input signal DEi divided by two, and corresponds to an odd-numbered horizontal period for supplying data voltages to respective sub-pixels connected to an odd-numbered gate line, among m number of horizontal periods H1 to Hm that are generated during the active period of the data enable input signal DEi.

On the other hand, the second enable period S2 of the first data enable signal DE1 is generated during the latter part among the fore part and latter part of each horizontal period H of the data enable input signal DEi divided by two, and corresponds to an even-numbered horizontal period for supplying data voltages to respective sub-pixels connected to an even-numbered gate line, among the m horizontal periods H1 to Hm that are generated during the active period of the data enable input signal DEi.

The second DE generation unit 223 generates the second data enable signal DE2 whose third and fourth enable periods S3 and S4 are alternately repeated during the vertical blank period Vblank of the data enable input signal DEi, on the basis of the vertical blank period Vblank of the data enable input signal DEi supplied from the data reception unit 210. That is, the second DE generation unit 223 generates the second data enable signal DE2 having the third and fourth enable periods S3 and S4 after a reference time tref from a falling time of the data enable input signal DEi for the last horizontal period Hm of the previous frame Fn-1. In this case, each of the third and fourth enable periods S3 and S4 of the second data enable signal DE2 has a high level and a low level identically to the first and second enable periods S1 and S2 of the first data enable signal DE1.

The second DE generation unit 223 may set a rising time and falling time of each of the third and fourth enable periods S3 and S4 of the second data enable signal DE2 by using a counter (not shown) for counting the reference clock Rclk, and generate the second data enable signal DE2. In this case, the reference time may be set to the sum of the number of offset clocks and the number of clocks corresponding to the time t1 from after the falling time of the data enable input signal DEi, and the number of offset clocks may be set to 32 reference clocks Rclk. However, the present invention is not limited thereto.

Figure 6A:
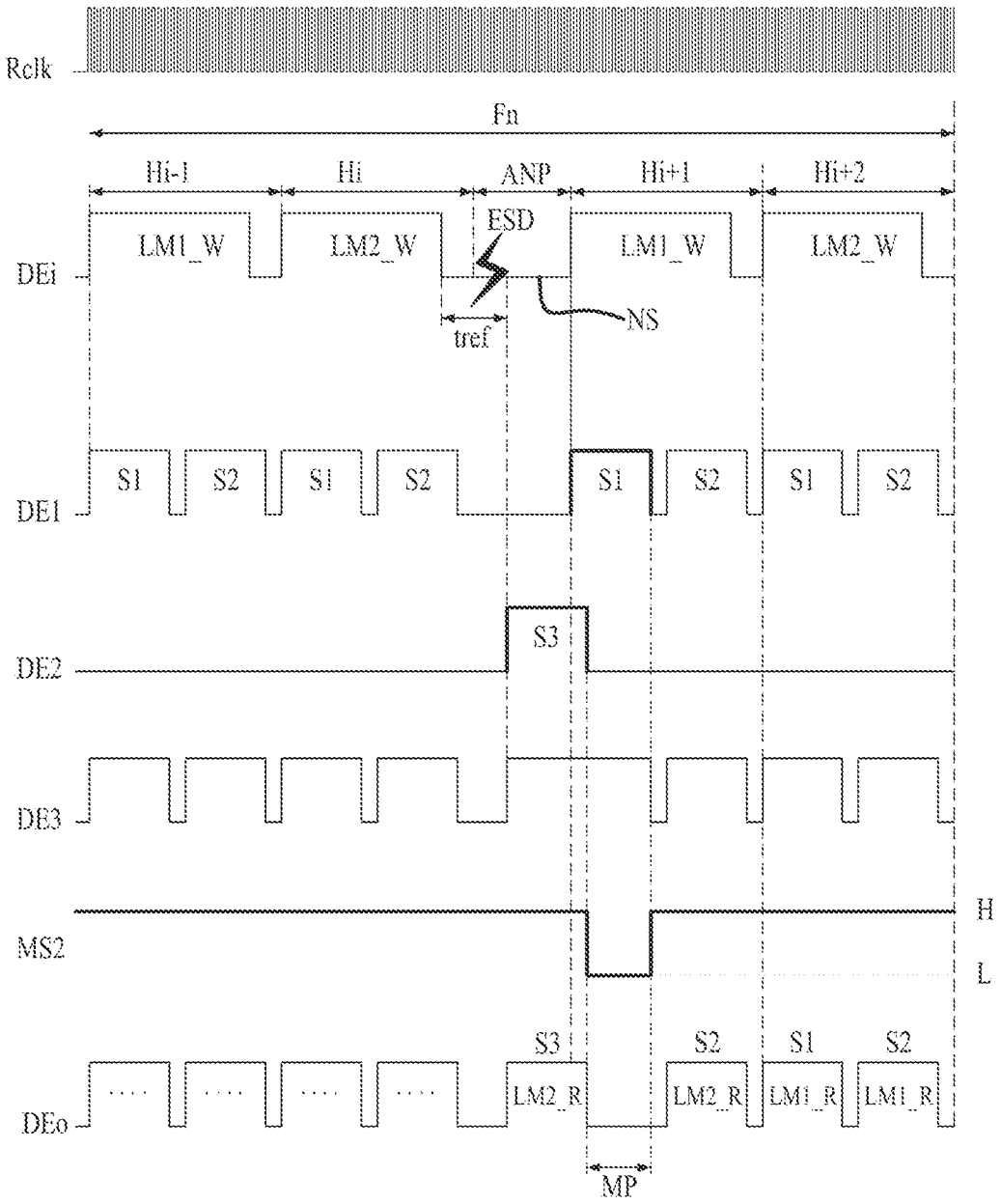
FIGS. 6A and 6B are waveform diagrams for describing an operation of masking an abnormal data enable input signal.
Figure 6B:
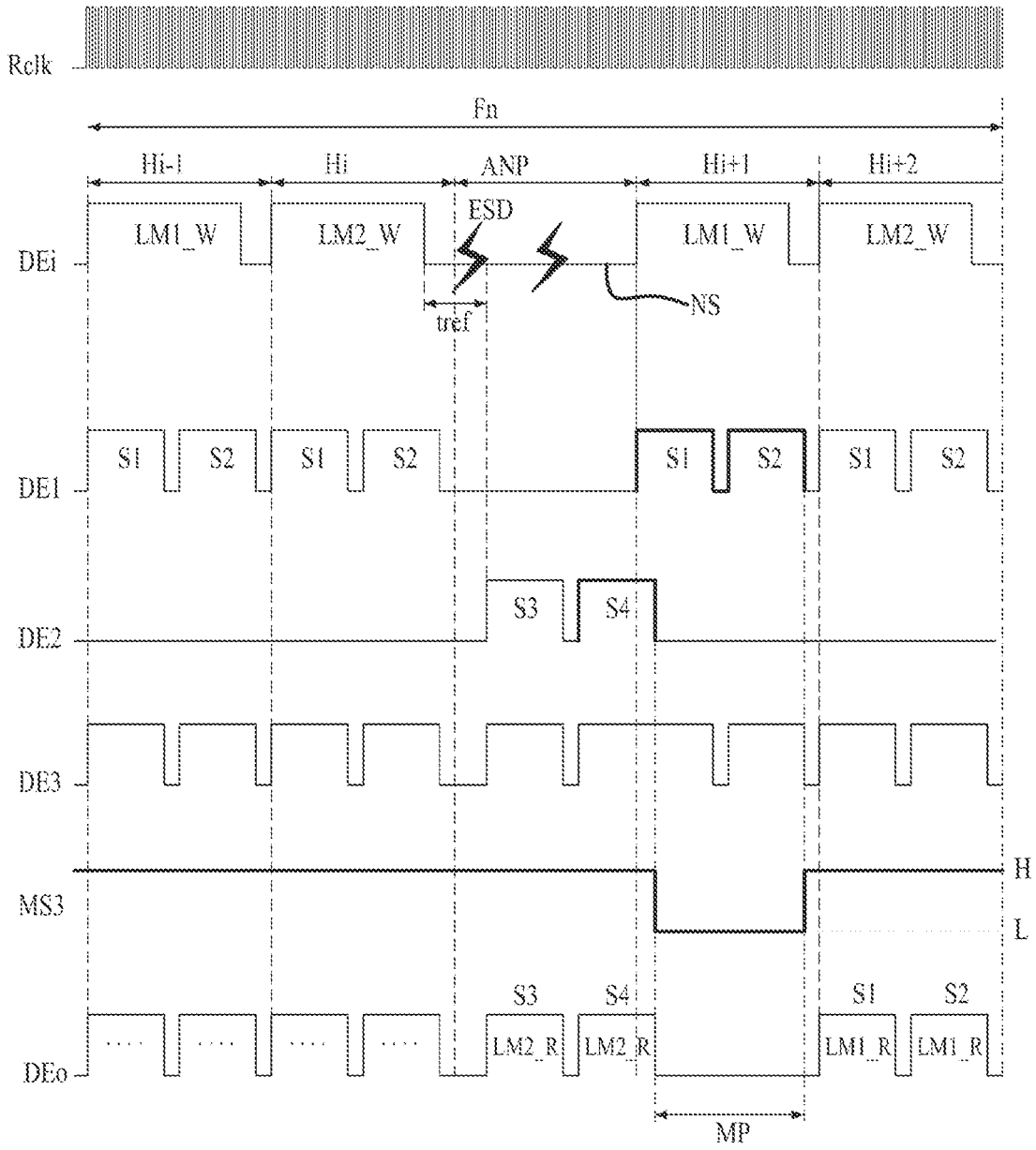

In transferring data between the driving system 110 and the timing controller 220, when noise such as static electricity penetrates into a data transfer line, an abnormal noise signal occurs in the data enable input signal DEi. For example, as shown in FIGS. 6A and 6B, the data enable input signal DEi may include an abnormal period ANP that is generated between an ith horizontal period Hi and an i+1st horizontal period Hi+1 by a low-level noise signal NS due to static electricity ESD mixed into an active period. Therefore, the second DE generation unit 223 mistakes the low-level noise signal of the abnormal period ANP as the vertical blank period Vblank of the data enable input signal DEi, and thus generates the second data enable signal DE2 that has the third enable period S3 or the third and fourth enable periods S3 and S4 after the reference time tref from the falling time of the ith horizontal period Hi. In this case, the second data enable signal DE2 that is generated on the basis of the abnormal period ANP, as shown in FIG. 6A, may include the third enable period S3 or, as shown in FIG. 6B, include the third and fourth enable periods S3 and S4, according to the duration of the abnormal period ANP maintaining a low level.

As a result, as in the vertical blank period Vblank and/or abnormal period ANP of the data enable input signal DEi, when the low level of the data enable input signal DEi is maintained for the reference time tref or more, the second DE generation unit 223 generates the third enable period S3 or the third and fourth enable periods S3 and S4, thereby generating the second data enable signal DE2. In this case, when generating the second data enable signal DE2 on the basis of the abnormal period ANP of the data enable input signal DEi, the existing problems occur, but, the present invention detects the abnormal period ANP of the data enable input signal DEi by using the masking signal generation unit 225 and masks the abnormal period ANP, thus solving the existing problems.

Referring again to FIG. 4, the masking signal generation unit 225 generates first to third masking signals for masking the noise signal of the abnormal period ANP of the data enable input signal DEi with the first and second data enable signals DE1 and DE2 respectively supplied from the first and second DE generation units 222 and 223, and supplies the first to third masking signals to the data enable output signal generation unit 227. That is, the masking signal generation unit 225 generates the first to third masking signals that disallow the first and second enable periods S1 and S2 of the first data enable signal DE1 to be masked or allow the first enable period S1 or the first and second enable periods S1 and S2 to be masked, according to whether the first and second data enable signals DE1 and DE2 overlap, and supplies the first to third masking signals to the data enable output signal generation unit 227.

First, as shown in FIG. 5, when the first enable period S1 of the first data enable signal DE1 does not overlap the third or fourth enable period S3 or S4 of the second data enable signal DE2, the masking signal generation unit 225 determines the data enable input signal DEi as a normal signal, and generates a first masking signal MS1 that disallows the first and second enable periods S1 and S2 of the first data enable signal DE1 to be masked. In this case, the first masking signal MS1 maintains a high level H during the entire period of the first data enable signal DE1.

On the other hand, as shown in FIG. 6A, when the first enable period S1 of the first data enable signal DE1 partially overlaps the third enable period S3 of the second data enable signal DE2, the masking signal generation unit 225 generates a second masking signal MS2 for masking the first enable period S1 of the first data enable signal DE1 overlapping the third enable period S3 of the second data enable signal DE2. The second masking signal MS2 maintains a low level during only a period overlapping the first enable period S1 of the first data enable signal DE1.

On the other hand, as shown in FIG. 6B, when the first enable period S1 of the first data enable signal DE1 partially overlaps the fourth enable period S4 of the second data enable signal DE2, the masking signal generation unit 225 generates a third masking signal MS3 for masking all the first and second enable periods S1 and S2 of the first data enable signal DE1 that overlap and succeed the fourth enable period S4 of the second data enable signal DE2. The third masking signal MS3 maintains a low level during only a period overlapping the first and second enable periods S1 and S2 of the first data enable signal DE1.

Referring again to FIG. 4, the data enable output signal generation unit 227 generates the data enable output signal DEo on the basis of one of the first to third masking signals MS1 to MS3 supplied from the masking signal generation unit 225, the first data enable signal DE1 supplied from the first DE generation unit 222, and the second data enable signal DE2 supplied from the second DE generation unit 223, and supplies the data enable output signal DEo to the control signal generation unit 229 and the data processing unit 230.

First, the data enable output signal generation unit 227 performs an OR operation on the first data enable signal DE1 and the second data enable signal DE2 to generate a third data enable signal DE3. Furthermore, the data enable output signal generation unit 227 performs an AND operation on the third data enable signal DE3 and one of the first to third masking signals MS1 to MS3 supplied from the masking signal generation unit 225 to generate the data enable output signal DEo.

In detail, when the first masking signal MS1 is supplied from the masking signal generation unit 225, the data enable output signal generation unit 227 performs an AND operation on the first masking signal MS1 having a high level and the third data enable signal DE3 to generate the data enable output signal DEo, and thus, as shown in FIG. 5, the data enable output signal generation unit 227 generates the data enable output signal DEo without masking the first data enable signal DE1.

On the other hand, when the second masking signal MS2 is supplied from the masking signal generation unit 225, the data enable output signal generation unit 227 performs an AND operation on the second masking signal MS2 and the third data enable signal DE3, and thus, as shown in FIG. 6A, by masking the first enable period S1 of the first data enable signal DE1 that is generated during an i+1st horizontal period Hi+1 of the data enable input signal DEi, the data enable output signal generation unit 227 generates the data enable output signal DEo. Therefore, the data enable output signal DEo includes the third enable period S3 overlapping the abnormal period ANP of the data enable input signal DEi, and a masking period MP and the second enable period S2 that overlap the i+1st horizontal period Hi+1 of the data enable input signal DEi.

When the third masking signal MS3 is supplied from the masking signal generation unit 225, the data enable output signal generation unit 227 performs an AND operation on the third masking signal MS3 and the third data enable signal DE3, and thus, as shown in FIG. 6B, by masking the first and second enable periods S1 and S2 of the first data enable signal DE1 that is generated during the i+1st horizontal period Hi+1 of the data enable input signal DEi, the data enable output signal generation unit 227 generates the data enable output signal DEo. Therefore, the data enable output signal DEo includes the third and fourth enable periods S3 and S4 overlapping the abnormal period ANP of the data enable input signal DEi, and the masking period MP overlapping the i+1st horizontal period Hi+1 of the data enable input signal DEi.

Figure 7:
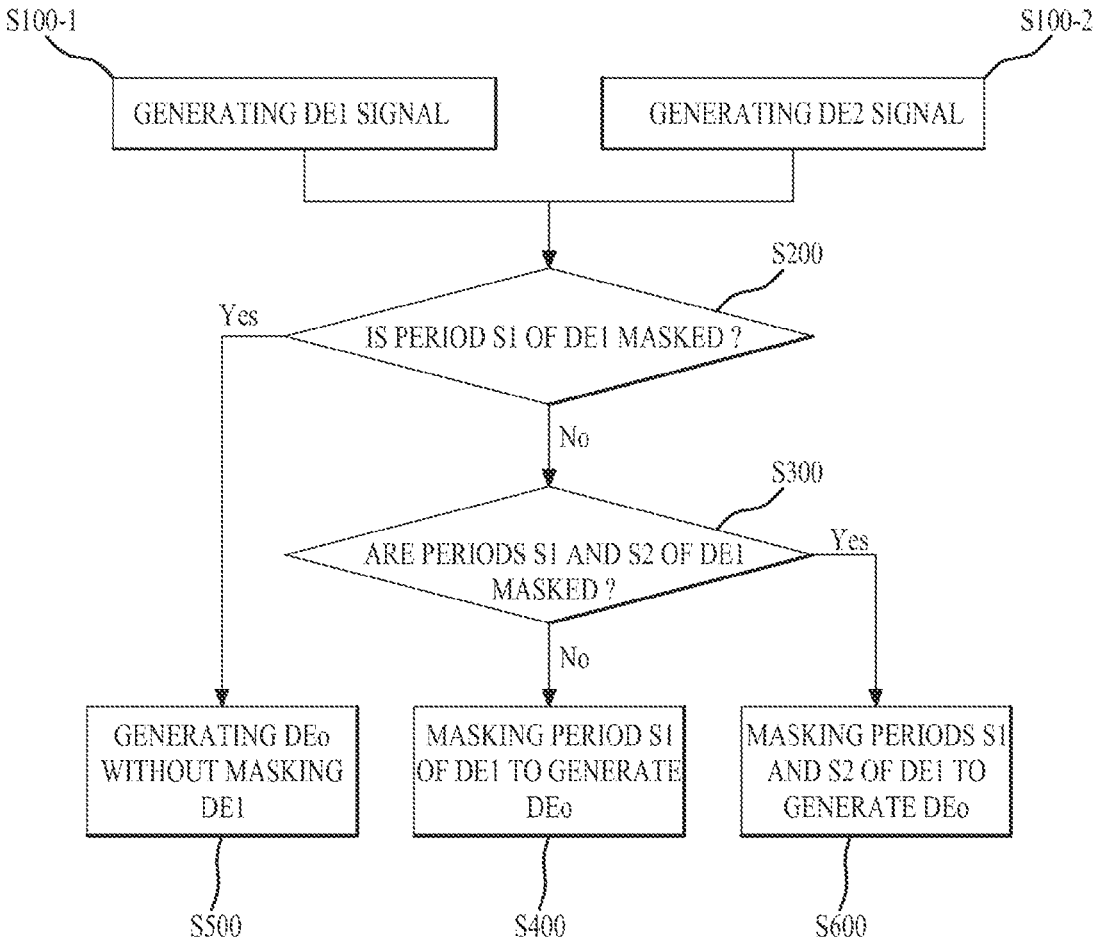
FIG. 7 is a flowchart sequentially illustrating an operation of generating a data enable output signal in the timing signal generation unit of FIGS. 3 and 4 according to one embodiment.

FIG. 7 is a flowchart sequentially illustrating an operation of generating a data enable output signal in the timing signal generation unit of FIGS. 3 and 4.

An operation of generating the data enable output signal will now be described in detail with reference to FIGS. 4 to 7.

First, the timing controller generates the first data enable signal DE1 having the first and second enable periods S1 and S2 of each horizontal period H of the data enable input signal DEi divided by two, during the active period of the data enable input signal DEi in operation S100-1. The first data enable signal DE1, as described above, is generated by the first DE generation unit 222.

The timing controller detects the noise signal NS of the vertical blank period Vblank or abnormal period ANP of the data enable input signal DEi to generate the second data enable signal DE2 having the third enable period S3 or the third and fourth enable periods S3 and S4 in operation S100-2. The second data enable signal DE2, as described above, is generated by the second DE generation unit 223.

Subsequently, the timing controller checks whether the first enable period S1 of the first data enable signal DE1 overlaps the third enable period S3 of the second data enable signal DE2 to determine whether to mask the first enable period S1 of the first data enable signal DE1 overlapping the third enable period S3 in operation S200. As described above, the masking signal generation unit 225 determines whether to mask the first enable period S1.

When it is determined in operation S200 that the first enable period S1 of the first data enable signal DE1 does not overlap the third enable period S3 of the second data enable signal DE2 (see "NO" in S200), the timing controller checks whether the first enable period S1 of the first data enable signal DE1 overlaps the fourth enable period S4 of the second data enable signal DE2 to determine whether to mask the first and second enable periods S1 and S2 of the first data enable signal DE1 that overlap and succeed the fourth enable period S4 in operation S300. As described above, the masking signal generation unit 225 determines whether to mask the first and second enable periods S1 and S2.

For example, as shown in FIG. 5, when it is determined in operation S300 that the first enable period S1 of the first data enable signal DE1 does not overlap the fourth enable period S4 of the second data enable signal DE2 (see "NO" in S300), the timing controller generates the first masking signal MS1 to generate the data enable output signal DEo without masking the first and second enable periods S1 and S2 of the first data enable signal DE1 in operation S400. As described above, the data enable output signal generation unit 227 generates the data enable output signal DEo without masking the first and second enable periods S1 and S2.

On the one hand, as shown in FIG. 6A, when it is determined in operation S200 that the first enable period S1 of the first data enable signal DE1 overlaps the third enable period S3 of the second data enable signal DE2 (see "YES" in S200), the timing controller generates the second masking signal MS2 to mask the first enable period S1 of the first data enable signal DE1 overlapping the third enable period S3, thereby generating the data enable output signal DEo in operation S500. As described above, the data enable output signal generation unit 227 generates the data enable output signal DEo that is generated by masking the first enable period S1.

On the other hand, as shown in FIG. 6B, when it is determined in operation S300 that the first enable period S1 of the first data enable signal DE1 overlaps the fourth enable period S4 of the second data enable signal DE2 (see "YES" in S300), the timing controller generates the third masking signal MS3 to mask the first and second enable periods S1 and S2 of the first data enable signal DE1 that overlap and succeed the fourth enable period S4, thereby generating the data enable output signal DEo in operation S600. As described above, the data enable output signal generation unit 227 generates the data enable output signal DEo that is generated by masking the first and second enable periods S1 and S2.

The timing signal generation unit 220 generates the data enable output signal DEo on the basis of the first data enable signal DE1 (which is generated during the active period of the data enable input signal DEi) and the second data enable signal DE2 that is generated during the abnormal period ANP of the data enable input signal DEi, thus preventing an image-quality defect due to an abnormal data enable input signal into which noise such as static electricity is mixed.

Referring again to FIGS. 3 and 4, the control signal generation unit 229 generates the gate control signal GCS for controlling the driving timing of the gate driver 300 and the data control signal DCS for controlling the driving timing of the data driver 400 on the basis of the data enable output signal DEo supplied from the data enable output signal generation unit 227.

The data processing unit 230 temporarily stores the restoration data Rdata (which are supplied from the data processing unit 210) for one horizontal line according to the data enable input signal DEi, selects one horizontal-line red, green, and blue data RGB corresponding to each horizontal period based on the DRD type among from the temporarily stored data according to the data enable output signal DEo, and supplies the selected data to the data transfer unit 240. To this end, the data processing unit 230 includes a data alignment unit 232, a first line memory LM1, and a second line memory LM2.

The data alignment unit 232 alternately writes the restoration data Rdata (which are supplied from the data processing unit 210) for one horizontal line in the first and second line memories LM1 and LM2 in units of one horizontal period according to the data enable input signal DEi. The data alignment unit 232 alternately reads one horizontal-line red, green, and blue display data RGB stored in the first and second line memories LM1 and LM2 and supplies the read data to the data transfer unit 240, according to the data enable output signal DEo.

In detail, as shown in FIGS. 5, 6A and 6B, the data alignment unit 232 writes the restoration data Rdata for an even-numbered horizontal line in the second line memory LM2 by using the odd-numbered horizontal periods H1 to Hm-1 of the data enable input signal DEi as a writing signal LM2_W for the second line memory LM2, and writes the restoration data Rdata for an odd-numbered horizontal line in the first line memory LM1 by using the even-numbered horizontal periods H2 to Hm of the data enable input signal DEi as a writing signal LM1_W for the first line memory LM1.

On the other hand, as shown in FIG. 5, by using each of the first and second enable periods S1 and S2 of the data enable output signal DEo (which are generated according to the odd-numbered horizontal periods H1 to Hm-1 of the data enable input signal DEi) as a read signal LM1_R for the first line memory LM1, the data alignment unit 232 sequentially reads the one horizontal-line red, green, and blue display data RGB from the first line memory LM1 and supplies the read data to the data transfer unit 240. Furthermore, by using each of the first and second enable periods S1 and S2 of the data enable output signal DEo (which are generated according to the even-numbered horizontal periods H2 to Hm of the data enable input signal DEi) as a read signal LM2_R for the second line memory LM2, the data alignment unit 232 sequentially reads the one horizontal-line red, green, and blue display data RGB from the second line memory LM2 and supplies the read data to the data transfer unit 240.

For example, referring to the pixel arrangement structure based on the DRD type in FIG. 2, the data alignment unit 232 reads display data RGB, supplied to respective sub-pixels R1, R2 and B2 connected to the first gate line GL1, from the first line memory LM1 according to the first enable period S1 of the data enable output signal DEo that is generated on the basis of the first horizontal period H1 of the data enable input signal DEi, and supplies the read data to the data transfer unit 240. Subsequently, the data alignment unit 232 reads display data RGB, supplied to respective sub-pixels G1, B1 and G2 connected to the second gate line GL2, from the first line memory LM1 according to the second enable period S2 of the data enable output signal DEo, and supplies the read data to the data transfer unit 240. Furthermore, the data alignment unit 232 reads display data RGB, supplied to respective sub-pixels R1, R2 and B2 connected to the third gate line GL3, from the second line memory LM2 according to the first enable period S1 of the data enable output signal DEo that is generated on the basis of the second horizontal period H2 of the data enable input signal DEi, and supplies the read data to the data transfer unit 240. Subsequently, the data alignment unit 232 reads display data RGB, supplied to respective sub-pixels G1, B1 and G2 connected to the fourth gate line GL4, from the second line memory LM2 according to the second enable period S2 of the data enable output signal DEo, and supplies the read data to the data transfer unit 240.

Operations of writing and reading the first and second line memories LM1 and LM2 are separately divided according to the masking of the first data enable signal DE1, and thus, a malfunction does not occur in the first and second line memories LM1 and LM2. For example, as seen in FIGS. 6A and 6B, it can be seen that the writing signal LM1_W for the first line memory LM1 does not overlap the read signal LM1_R for the first line memory LM1 according to the masking of the first data enable signal DE1, and it can be seen that the writing signal LM2_W for the second line memory LM2 does not overlap the read signal LM2_R for the second line memory LM2.

Referring again to FIGS. 3 and 4, the data transfer unit 240 supplies the one horizontal-line display data RGB, supplied from the data processing unit 230 (i.e., the data alignment unit 232), to the data driver 400. Here, the data transfer unit 240 may convert the display data RGB into a data packet RGB and supply the data packet RGB to the data driver 400. At this point, the data driver 400 receives the data packet RGB transferred from the data transfer unit 240, samples the display data included in the data packet RGB to convert the display data into data voltages, and supplies the data voltages to the respective data lines. In this case, a data interface between the timing controller 200 and the data driver 400 using the data packet RGB may be implemented in an interface method disclosed in Korean Patent Application No. 10-2008-0127456 or Korean Patent Application No. 10-2008-0127458 filed by the applicant.

The LCD device according to the embodiments of the present invention generates the data enable output signal DEo on the basis of the first data enable signal DE1 (which is generated during the active period of the data enable input signal DEi) and the second data enable signal DE2 which is generated during the abnormal period ANP of the data enable input signal DEi, and thereby can prevent an image-quality defect such as an abnormal screen having a flashing state due to omission of a display line or data mixing which is caused by the abnormal data enable input signal into which noise such as static electricity is mixed, thus preventing an error in an operation of writing and reading the line memory.

In the above-described LCD device according to the embodiments of the present invention, it has been described above that the timing controller generates the data enable output signal whose the first and second enable periods are alternately repeated during the active period of the data enable input signal for driving the sub-pixels arranged in the DRD type, but is not limited thereto. The present invention may be applied to a triple rate driving (TRD) type in which three sub-pixels share one data line. In the TRD type, one horizontal period of a data enable input signal is divided into three periods, the timing controller generates a data enable output signal whose first to third enable periods are alternately repeated during the active period of the data enable input signal. As a result, the timing controller of the LCD device according to the present invention generates a data enable output signal for sequentially driving a plurality of sub-pixels, which are arranged in parallel on the same horizontal line, during two or more horizontal periods.

As described above, the timing controller and the LCD device according to the present invention generate the data enable output signal on the basis of the first data enable signal (which is generated during the active period of the data enable input signal) and the second data enable signal which is generated during the abnormal period of the data enable input signal, and thereby can prevent an image-quality defect such as an abnormal screen having a flashing state due to omission of a display line or data mixing which is caused by the abnormal data enable input signal into which noise such as static electricity is mixed, thus preventing an error in an operation of writing and reading the line memory.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A timing controller for sequentially driving a plurality of sub-pixels, which are arranged in parallel on the same horizontal line, during a plurality of horizontal period, the timing controller comprising:

a reception unit receiving input data and a data enable input signal;

a timing signal generation unit generating a first data enable signal based on an active period of the data enable input signal supplied from the reception unit, generating a second data enable signal based on an abnormal period during which noise occurs in the data enable input signal, the abnormal period subsequent the active period, masking a first portion of the first data enable signal responsive to a portion of the second data enable signal overlapping a second portion of the first data enable signal due to the noise occurring on the data enable input signal, and generating a data enable output signal based on the masked first data enable signal and the second data enable signal; and a data processing unit temporarily storing the input data according to the data enable input signal, selecting display data corresponding to a horizontal period based on double rate driving (DRD) from the temporarily stored data according to the data enable output signal, and outputting the selected display data.

2. The timing controller of claim 1, wherein, the timing signal generation unit performs a logical operation on the first data enable signal and the second data enable signal to generate a third data enable signal, generates a masking signal according to the second portion of the first data enable signal that overlaps the portion of the second data enable signal, and performs a logical operation on the third data enable signal and the masking signal to generate the data enable output signal.

3. The timing controller of claim 1, wherein, the first data enable signal comprises: a first enable period corresponding to an odd horizontal period among the plurality of horizontal periods and a second enable period corresponding to an even horizontal period among the plurality of horizontal periods, the first enable period and the second enable period being alternately generated during the active period of the data enable input signal, and the second data enable signal comprises: a third enable period that is generated in synchronization with the abnormal period or a third enable period and a fourth enable period that are successively generated in synchronization with the abnormal period to have the same form as the first enable period and the second enable period.

4. The timing controller of claim 3, wherein responsive to the first enable period not overlapping the third enable period and the fourth enable period, the timing signal generation unit generates the data enable output signal without masking the first data enable signal.

5. The timing controller of claim 3, wherein when the first enable period partially overlaps the third enable period, the timing signal generation unit masks the first enable period overlapping the third enable period to generate the data enable output signal.

6. The timing controller of claim 3, wherein when the first enable period partially overlaps the fourth enable period, the timing signal generation unit masks the first enable period and the second enable period, which overlap and succeed the fourth enable period, to generate the data enable output signal.

7. The timing controller of claim 1, wherein the timing signal generation unit comprises:

a first data enable signal generation unit generating the first data enable signal in which a first enable period corresponding to an odd horizontal period among the plurality of horizontal periods and a second enable period corresponding to an even horizontal period among the plurality of horizontal periods are alternately repeated during the active period of the data enable input signal;

a second data enable signal generation unit generating the second data enable signal that has third and fourth enable periods that are alternately repeated to have the same form as the first and second enable periods during a vertical blank period of the data enable input signal, and has the third enable period or the third and fourth enable periods during the abnormal period;

a masking signal generation unit generating a masking signal according to whether the first data enable signal and the second data enable signal overlap; and a data enable output signal generation unit performing a logical operation on the first data enable signal and the second data enable signal to generate a third data enable signal, and performing a logical operation on the third data enable signal and the masking signal to generate the data enable output signal.

8. The timing controller of claim 7, wherein, when the first enable period does not overlap the third enable period and the fourth enable period, the masking signal generation unit generates a first masking signal that disallows the first data enable signal to be masked, when the first enable period partially overlaps the third enable period, the masking signal generation unit generates a second masking signal for masking the first enable period overlapping the third enable period, and when the first enable period partially overlaps the fourth enable period, the masking signal generation unit generates a third masking signal for masking the first enable period and the second enable period that overlap and succeed the fourth enable period.

9. The timing controller of claim 8, wherein, the data enable output signal generation unit performs an OR operation on the first data enable signal and the second data enable signal to generate the third data enable signal, and performs an AND operation on the third data enable signal and one of the first masking signal, the second making signal, or the third masking signal to generate the data enable output signal.

10. The timing controller of claim 1, wherein, the data processing unit comprises a data alignment unit, the data alignment unit alternately writes the input data, received by the reception unit, in a first line memory and a second line memory in units of one horizontal period of the data enable input signal, and the data alignment alternately reads the data, respectively stored in the first line memory and the second line memory, in units of one horizontal period of the data enable output signal.

11. A liquid crystal display (LCD) device, comprising:

a liquid crystal display panel comprising a plurality of sub-pixels that are respectively formed in a plurality of areas prepared by intersections between a plurality of gate lines and a plurality of data lines;

a timing controller sequentially driving the plurality of sub-pixels, which are arranged in parallel on the same horizontal line, during a plurality of horizontal period;

a gate driver sequentially driving the plurality of gate lines to sequentially connect a plurality of sub-pixels, which are arranged in parallel on the same horizontal line, to a plurality of gate lines according to a gate control signal supplied from the timing controller; and a data driver receiving display data and a data control signal from the timing controller, and converting the display data into data voltages to supply the data voltages to respective data lines to be synchronized with the driving of the gate lines according to the data control signal;

wherein the timing controller comprises:

a reception unit receiving input data and a data enable input signal;

a timing signal generation unit generating a first data enable signal based on an active period of the data enable input signal supplied from the reception unit, generating a second data enable signal based on an abnormal period during which noise occurs in the data enable input signal, the abnormal period subsequent the active period, masking a first portion of the first data enable signal responsive to a portion of the second data enable signal overlapping a second portion of the first data enable signal due to the noise occurring on the data enable input signal, and generating a data enable output signal based on the masked first data enable signal and the second data enable signal; and a data processing unit temporarily storing the input data according to the data enable input signal, selecting display data corresponding to a horizontal period based on double rate driving (DRD) from the temporarily stored data according to the data enable output signal, and outputting the selected display data.

12. The LCD device of claim 11, wherein the timing signal generation unit comprises a control signal generation unit generating the data control signal and the gate control signal according to the data enable output signal.

13. The LCD device of claim 11, wherein two adjacent sub-pixels that are arranged in parallel on the same horizontal line are in common connected to one data line, and are sequentially driven according to the horizontal period based on double rate driving (DRD).

14. The LCD device of claim 11, wherein, the timing signal generation unit performs a logical operation on the first data enable signal and the second data enable signal to generate a third data enable signal, generates a masking signal according to the second portion of the first data enable signal that overlaps the portion of the second data enable signal, and performs a logical operation on the third data enable signal and the masking signal to generate the data enable output signal.

15. The LCD device of claim 11, wherein, the first data enable signal comprises: a first enable period corresponding to an odd horizontal period among the plurality of horizontal periods and a second enable period corresponding to an even horizontal period among the plurality of horizontal periods, the first enable period and the second enable period being alternately generated during the active period of the data enable input signal, and the second data enable signal comprises: a third enable period that is generated in synchronization with the abnormal period or a third enable period and a fourth enable period that are successively generated in synchronization with the abnormal period to have the same form as the first enable period and the second enable period.

16. The LCD device of claim 15, wherein responsive to the first enable period not overlapping the third enable period and the fourth enable period, the timing signal generation unit generates the data enable output signal without masking the first data enable signal.

17. The LCD device of claim 15, wherein when the first enable period partially overlaps the third enable period, the timing signal generation unit masks the first enable period overlapping the third enable period to generate the data enable output signal.

18. The LCD device of claim 15, wherein when the first enable period partially overlaps the fourth enable period, the timing signal generation unit masks the first enable period and the second enable period, which overlap and succeed the fourth enable period, to generate the data enable output signal.

19. A display device comprising:

a liquid crystal panel comprising a plurality of data lines, a plurality of gate lines, and a plurality of pixels having odd-column pixels each of which is connected to a first side of one of the data lines and connected to an associated odd gate line, and even-column pixels each of which is connected to a second side of one of the data lines and connected to an associated even gate line; and a timing controller configured to control each pixel during a plurality of horizontal periods, the timing controller comprising:

a reception unit receiving input data and a data enable input signal;

a timing signal generation unit generating a first data enable signal, being alternately repeated with first and second enable periods, based on an active period of the data enable input signal supplied from the reception unit, generating a second data enable signal having a third enable period, based on an abnormal period which a noise occurs in the data enable input signal, being subsequent the active period, masking a portion of the first data enable signal overlapping between the first enable period of the first data enable signal and the third enable period of the second data enable signal, and generating a data enable output signal that is generated by masking the first enable period; and a data processing unit temporarily storing the input data according to the data enable input signal, selecting display data corresponding to a horizontal period based on double rate driving (DRD) from the temporarily stored data according to the data enable output signal, and outputting the selected display data.

20. The display device of claim 19, wherein the first enable period of the first data enable signal corresponds to an odd-numbered horizontal period, being a fore part of each horizontal period divided by two, for supplying data voltages to each pixel connected to an odd-numbered gate line.

21. The display device of claim 19, wherein the second enable period of the first data enable signal corresponds to an even-numbered horizontal period, being a latter part each horizontal period divided by two, for supplying data voltages to each pixel connected to an even-numbered gate line.

* * * * *